United States Patent [19]

Pol et al.

[11] Patent Number: 4,971,515

[45] **Date of Patent: * Nov. 20, 1990**

[54] APPARATUS FOR MOVING INDIVIDUAL SHEETS FROM A STACK OF SHEETS

[75] Inventors: Kenneth J. Pol, Saginaw; James F. Foster, Lansing; Jack D. Gyger, Charlotte; Lawrence P. Hyland, Portland, all of Mich.

[73] Assignee: Roberts Corporation, Lansing, Mich.

[ * ] Notice: The portion of the term of this patent subsequent to Feb. 14, 2006 has been disclaimed.

[21] Appl. No.: 275,043

[22] Filed: Nov. 22, 1988

Related U.S. Application Data

[63] Continuation of Ser. No. 740,938, Jun. 3, 1985, Pat. No. 4,804,173.

[51] Int. Cl.[5] ..... B65H 3/08; B65H 7/12

[52] U.S. Cl. ..... 414/797; 271/262; 414/21; 414/752

[58] Field of Search ..... 271/10, 11, 18, 19, 271/31, 104, 105, 110, 111, 91, 93, 258–263; 83/410; 209/601–605; 414/21, 752, 797, 786

[56] References Cited

U.S. PATENT DOCUMENTS

| | | | |
|---|---|---|---|
| 2,936,171 | 5/1960 | Williams | 271/91 X |
| 3,215,427 | 11/1965 | Pierce, Jr. | 271/93 |
| 3,409,149 | 11/1968 | Graux | 271/11 |
| 3,716,147 | 2/1973 | Pipes | 414/21 |
| 4,391,439 | 7/1983 | Edström | 271/108 X |
| 4,806,071 | 2/1989 | Sartorio | 414/797 X |

FOREIGN PATENT DOCUMENTS

| | | | |
|---|---|---|---|
| 61-27846 | 2/1986 | Japan | 414/797 |
| 1007793 | 3/1983 | U.S.S.R. | 414/797 |

*Primary Examiner*—Robert J. Spar
*Assistant Examiner*—Janice Krizek
*Attorney, Agent, or Firm*—Raymond J. Eifler; John R. Benefiel; Thomas K. Ziegler

[57] ABSTRACT

A measuring device (60) measures the value (t) of a chosen parameter (thickness) of what has been lifted by a lifting assembly (40) from a stack of sheets (1) of material and allows the lifted material to be moved from the stack when the value is in a predetermined relationship to a reference value (T). One (45*a*) of a plurality of selectively releasable members (45) on the lifting assembly (40) is moveable in two horizontal directions to locate a sheet attached to the one releaseable member (45*a*) against locating pins (5, 6) on the work table (3) of the punch press (4). The entire system may be operated automatically by a controller (90).

10 Claims, 14 Drawing Sheets

APPARATUS FOR MOVING INDIVIDUAL SHEETS FROM A STACK OF SHEETS

This is a continuation of co-pending application Ser. No. 06/740,938 filed on Jun. 3, 1985, now U.S. Pat. No. 4,804,173.

This invention relates to a lifting apparatus that may be used to automatically move individual sheets from a stack of sheets and accurately position them on the work processing table of a punch press.

In the operation of a punch press it is necessary to transfer a metal sheet from a stack of metal sheets onto the work table of a punch press. Current practice has been either to manually move the metal sheets onto the work table or utilize an automatic sheet feeding mechanism. Manual loading of sheets onto the punch press work table is slow and, if the operator isn't careful or mishandles the sheets, injury to the operator or damage to the sheets may occur. Further, manual loading may not be physically possible for large metal sheets. Automatic sheet feeding mechanisms pick up the top sheet from a stack of sheets and moves it onto a work table where a separate mechanism, built into the punch press work table, pushes or pulls the sheet into the punch press grippers and against alignment pins. The size of a sheet which a punch press can handle is limited to the size of the sheet that its work table mechanisms can handle i.e. a mechanism that properly orients or positions onto and feeding each sheet of metal into the punch press. Examples of mechanisms used to lift metal sheets and feed the sheets into a punch press may be found in U.S. Pat. Nos.: 4,392,766entitled "Automatic Feeding Apparatus", issued Jul. 12, 1983; 2,225,006, entitled "Sheet Feeding", issued Dec. 17, 1940; and 2,217,983, entitled "Sheet Handling Apparatus", issued Oct. 15, 1940.

Accordingly, sheet feeding apparatus that are not part of the punch press work table do not include a mechanism for properly orienting a sheet of metal on the punch press work table or preventing two sheets from being fed into the punch press. The feeding of more than one sheet into the punch press is a serious problem as it may cause damage to the punch press and result in material being scrapped.

DISCLOSURE OF THE INVENTION

This invention provides a method and apparatus that can be used for lifting and moving individual sheets of material from a stack of sheets, onto the work table of a punch press, properly positioning it on the work table and then releasing it for processing through the punch press. The invention is characterized by a lifting apparatus wherein one of a plurality of suction cups can move in two horizontal directions to position a sheet of material on the punch press work table. The invention may also be characterized by a measuring device that identifies that only one sheet of material has been lifted. The apparatus may be used in a system that may be operated automatically by a controller.

Accordingly, it is an advantage of this invention is to provide a material feeder for a punch press that includes a mechanism for properly orienting or positioning a sheet of material against locating pins on the work table of the punch press.

Another advantage of this invention to provide a method and apparatus for determining whether or not more than one sheet of material has been lifted by a lifting assembly.

Another advantage of this invention is to provide a method and apparatus for automatically moving a single sheet of material from a stack of sheets onto the work table of the punch press thereby decreasing manufacturing time and costs.

Another advantage of this invention is to eliminate the need for manual loading and locating of a sheet material into a punch press, thereby increasing the operating efficiency of the punch press.

Another advantage of this invention is to provide an apparatus that can lift and move sheets of varying thicknesses and surface areas.

DESCRIPTION OF THE INVENTION

Figure 1:
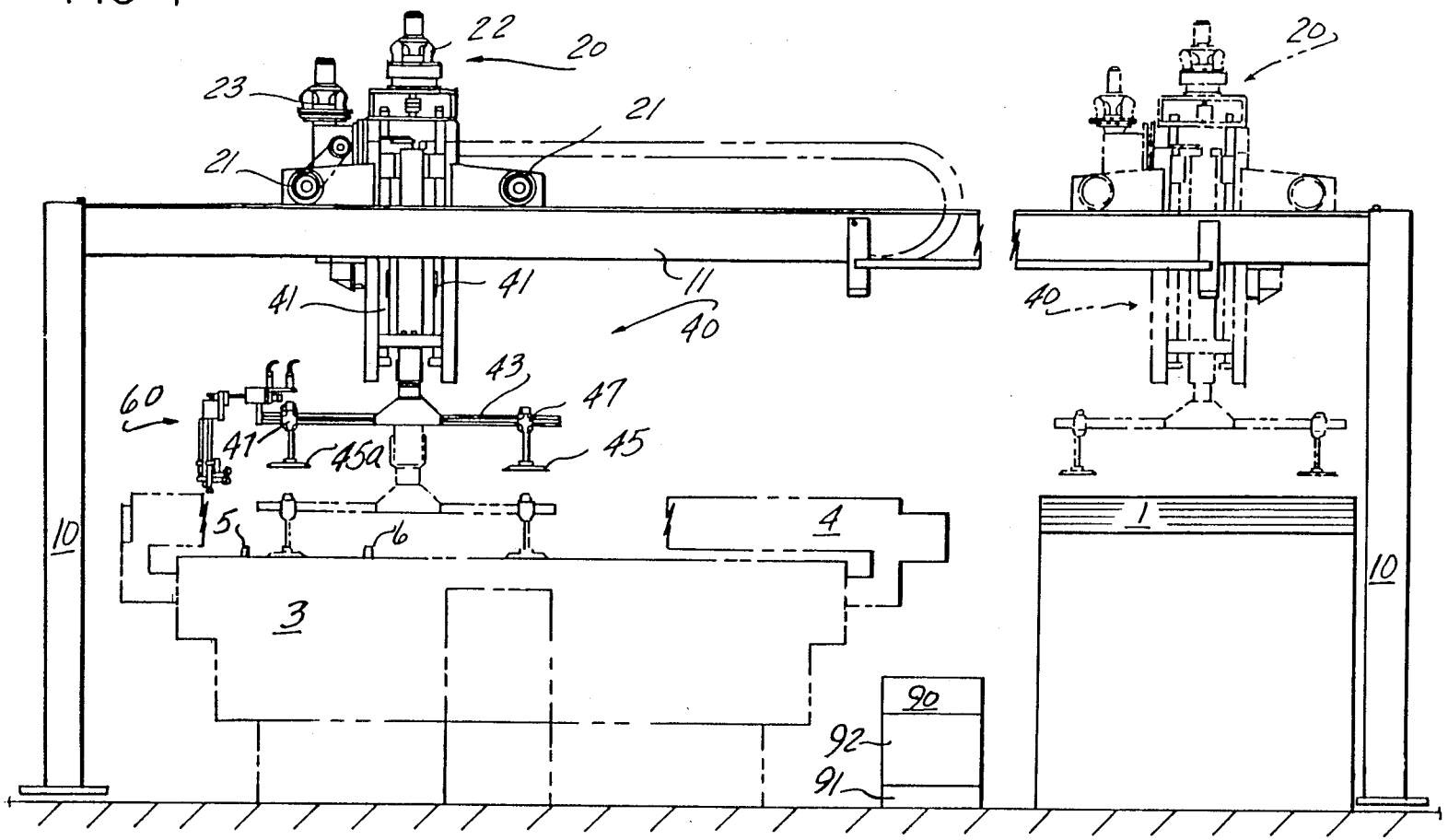
FIG. 1 is a side view of the apparatus for moving sheets of metal onto a punch press work table.

Referring now to the drawings FIG. 1 illustrates an apparatus for moving individual sheets 1 of material, such as metal or plastic, from a stack of sheets onto a work processing table 3 of a punch press 4. The apparatus includes a frame 10, a carriage 20 moveably mounted along tracks 11 of the frame 10, and a lifting assembly 40 mounted to the carriage 20. The carriage 20 includes a plurality of wheels 21 that ride along the tracks 11 of the frame 10. Also mounted on the carriage 20 are motors 22, 23 for operating the carriage 20 and the lifting apparatus 40. The air motors are of the radial piston-type manufactured by Fenner Company of England. A flexible cable tray 25 protects compressed air lines and control wiring (not shown) that run to the motors 22, 23 and limit switches mounted on the carriage 20. The carriage 20 and lifting assembly 40 are shown located in a first position over a stack of metal sheets 1 and in a second position where the carriage 20 and lifting assembly 40 are over the work table 3 of a punch press 4. Locating pins 5, 6 on the work table 3 are for precisely locating a sheet of metal 1 for processing by mechanisms within the punch press 4. The lifting assembly 40 is generally comprised of a vertical upright member 41 that is driveably connected to the motor 22 for up and down movement of horizontal members 43. This is accomplished by a ball screw mechanism (not shown). Mounted to the horizontal members 43 are a plurality of devices 45 that are designed to be releasably attached to a metal sheet 1. Examples of such devices are electromagnets and suction cups. Preferably, suction cups 45 may be used to pick up metal sheets having various thicknesses and surface areas. The suction cups are mounted so that they can be moved to different fixed positions on the horizontal members 43 by clamping mechanisms 47. The suction cups 45 are preferably pneumatically operated and include valves for selectively operating each of the suction cups 45 either manually or automatically. Mounted to one of the horizontal members 43 is an apparatus 60 for measuring the thickness of a metal sheet 1 attached to the suction cups 45 and lifted by the lifting assembly 40. For purposes of clarity the mechanism for moving one of the suction cups 45*a* in two directions in a horizontal plane are not shown in this figure. A comparator 91 such as an Action Instruments Model No. AP1002 is used for comparing the thickness "t" of a sheet or sheets picked up by the suction cups 45 to a predetermined reference thickness "T" and providing a signal when the measured thickness "t" is less than twice the reference thickness "T". To allow for tolerances and minor erros, the comparator 91 is set to provide a signal as long as "t" does not exceed 1.5 T. Alternately, other chosen parameters of the metal sheet may be used e.g., weight, size. A computer or controller 90 may be programmed for automatically controlling the entire system. One such controller 90 for the system would be an Allen-Bradley mini controller, Model PLC #1772LN3. For convenience the controller 90, comparator 91 and a control panel 92 are located in a single cabinet.

Figure 2:
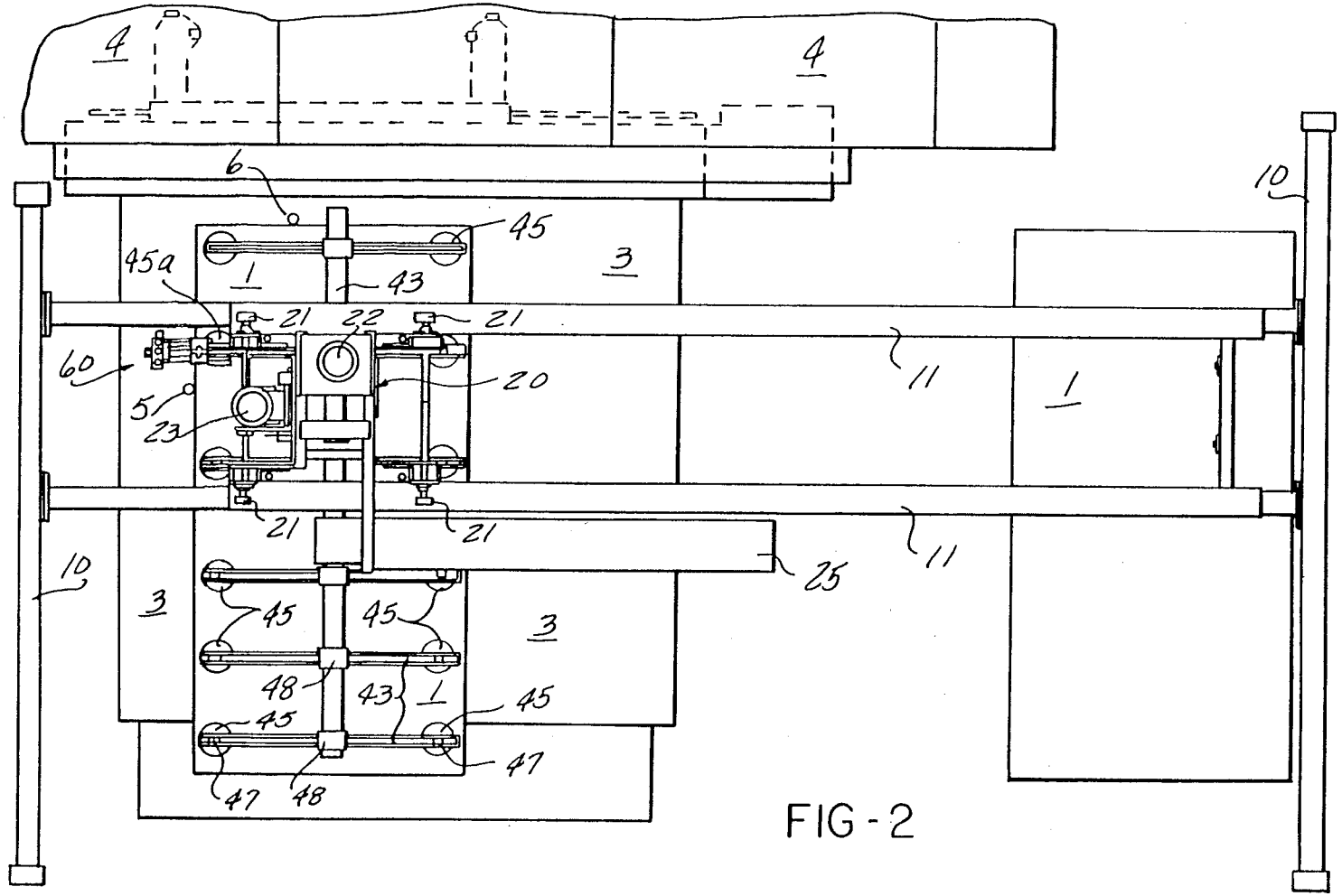
FIG. 2 is a top view of the same apparatus.

FIG. 2 shows a top view of the apparatus and includes a main frame 10 having two tracks 11 upon which a carriage 20 is moveably mounted. The carriage 20 includes wheels 21 that run along the tracks 11 of the frame 10. To protect flexible conduits that run to the carriage 20 there is a flexible cable tray 25. The conduits may include compressed air lines and control wiring that run to motors 22, 23 mounted on the carriage 20. The motors 22, 23 are preferably air motors but electrical motors and hydraulic motors may also be used. The suction cups 45, and horizontal members 43 are mounted with releasable clamps 47, 48 so that they both may be moved inwardly and outwardly with respect to the carriage 20 to pick up sheets of metal 1 of varying sizes. Extending from the horizontal member 43 which supports one of the suction cups 45*a* is a mechanism 60 for measuring the thickness of a metal sheet attached to and lifted by the suction cups 45 of the lifting assembly.

Figure 3:
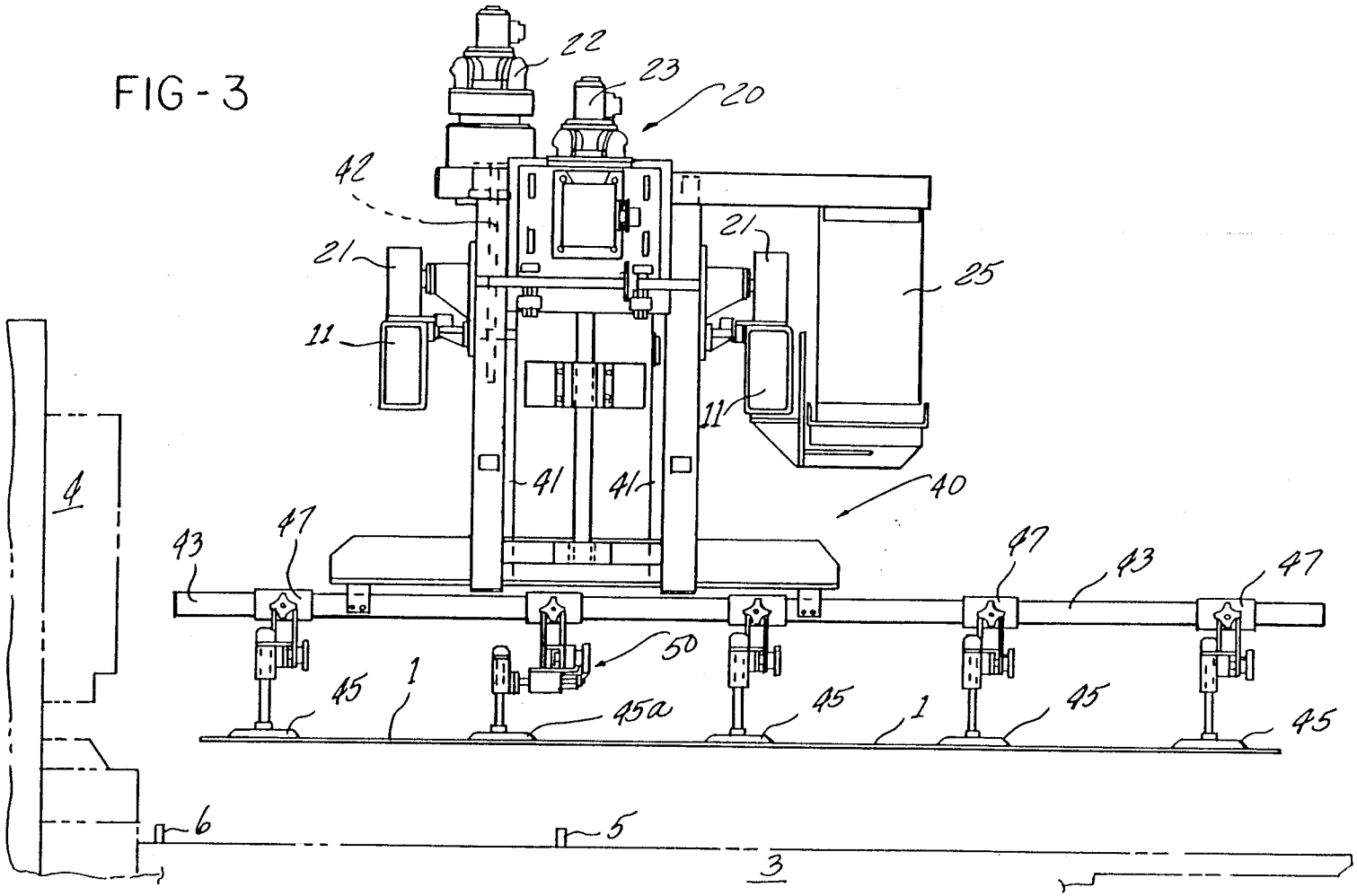
FIG. 3 is an enlarged end view of a portion of the apparatus.

FIG. 3 illustrates an enlarged end view of the carriage 20 and lifting assembly 40 with a sheet of metal 1 held by the suction cups 45. Associated with one of the suction cups 45*a* is a mechanism 50 for moving one suction cup 45*a* in at least one horizontal direction relative to the horizontal member 43. Preferably the mechanism 50 moves the suction cup 45*a* in two horizontal directions allowing the sheet of metal to be precisely located against pins 5, 6 on the punch press work table. The details of this mechanism 50 are shown in FIGS. 7 through 10. After the sheet of metal 1 is placed on the punch press work table 3, all but one 45*a* of the suction cups 45 are released and raised to a position spaced from the sheet. The mechanism 50 that moves suction cup 45*a* can then be used to move the metal sheet 1 against one or more locating pins 5, 6 in the work table. Simultaneously movement of the suction cup 45*a* in two directions by the apparatus 50 will allow the metal sheet 1 to pivot about a locating pin 5 or 6 for accurate placement of the sheet on the punch press work table 3. Not shown in this figure for purposes of clarity is the apparatus 60 that measures the thickness of a metal sheet 1 that is attached to suction cup 45*a*.

Figure 4:
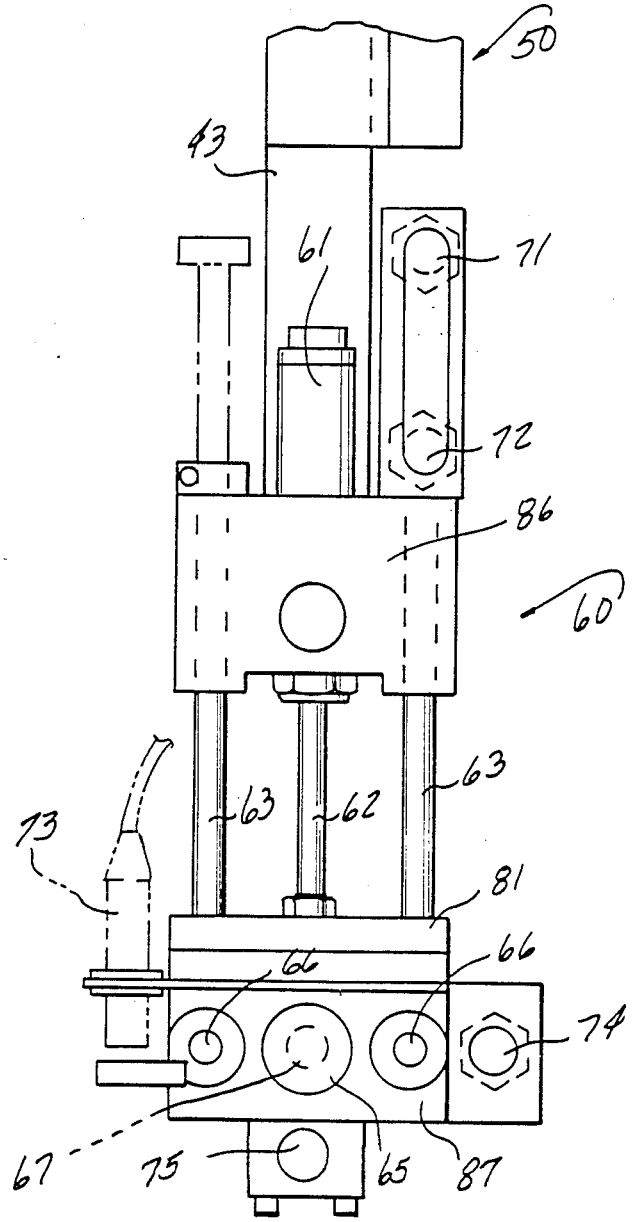
FIGS. 4 through 6 are views of the sheet thickness measuring device and a portion of the lifting mechanism.

FIG. 4 is a top view of the apparatus 60 for measuring the thickness of a metal sheet raised by the lifting apparatus. The measuring apparatus 60 is mounted to the end portion of a horizontal member 43 of the lifting assembly 20 and includes a first pneumatic cylinder housing 61 for providing movement in a horizontal direction and a second pneumatic cylinder housing 65 for providing movement in a vertical direction. Associated with the first cylinder housing 61 is a cylinder rod 62 which moves in a horizontal direction in and out of the cylinder housing 61 in response to pneumatic pressure in the cylinder housing. Attached to one end of the cylinder rod 62 is a bracket 81 that connects to the second pneumatic cylinder housing 65 so that movement of the cylinder rod 62 moves the second pneumatic cylinder housing 65 in a horizontal direction. Guide rods 63, slideably mounted by bracket 86 to the first pneumatic cylinder housing 61, assist in supporting and guiding the movement of the second pneumatic cylinder housing 65, Proximity switches 71 and 72 sense the movement and location of the guide rods 63 and hence the location of the second pneumatic cylinder housing 65. Similarly, proximity switches 73 and 74 sense the movement of guide rods 66 associated with the vertically moving cylinder rod 67 of the second pneumatic cylinder housing 65. The guide rods 66 are slideably mounted to bracket 87 which is mounted to the cylinder rod 62 of the first cylinder housing 61. Although in this embodiment proximity switches are shown mechanical limit switches may also be used. Transducer 75, of the LVDT type, is shown at the forward end of the measuring assembly 60 for providing and electrical signal which is a function of the thickness of a raised sheet or sheets. Although pneumatic cylinders are preferred, hydraulic cylinders and electromagnetic devices may also be used.

Figure 5:
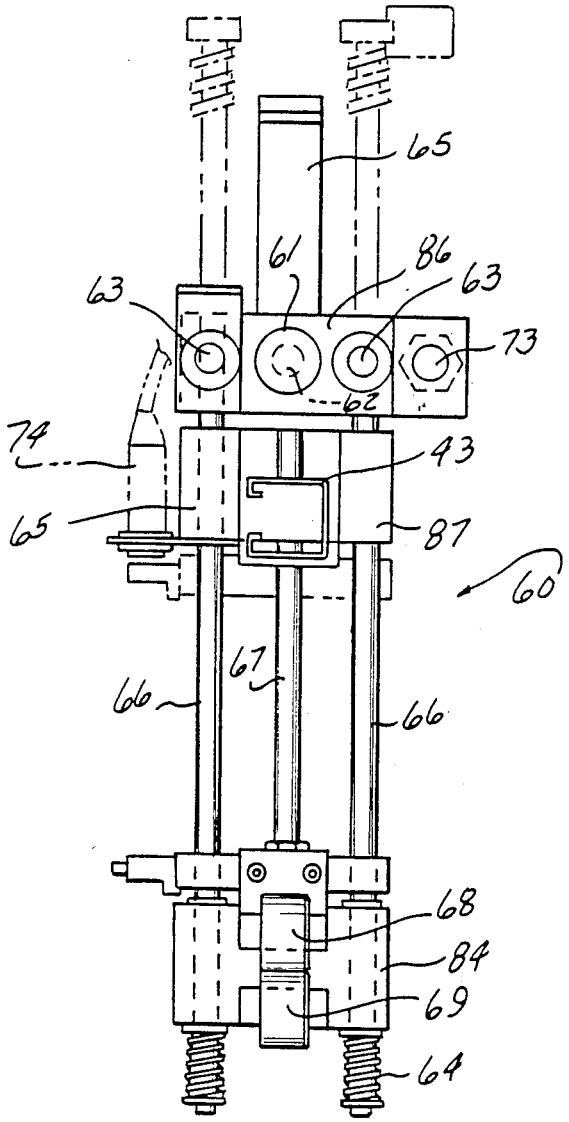

FIG. 5 is an end view of the measuring apparatus 60 looking outwardly from the horizontal member 43. Attached to the cylinder rod 67 of the second pneumatic cylinder housing 65 is a bracket 84 having mounted thereon a mechanical roller type contact 69. A second roller type mechanical contact 68 is fixedly mounted to the guide rods 66 of the second pneumatic housing 65. Movement of the cylinder rod 67 of the second pneumatic cylinder housing 65 will cause the second roller type mechanical contact 68 to move in a vertical direction. A spring 64 biases the bracket 84 and the first mechanical roller type contact 69 in an upward direction. Alternately, other parameters associated with the sheet of material can be used, e.g. thickness, weight, size and electrical capacitance and resistance. Both contacting and non contact gauging devices may also be used to obtain a parameter of the sheet of material.

Figure 6:
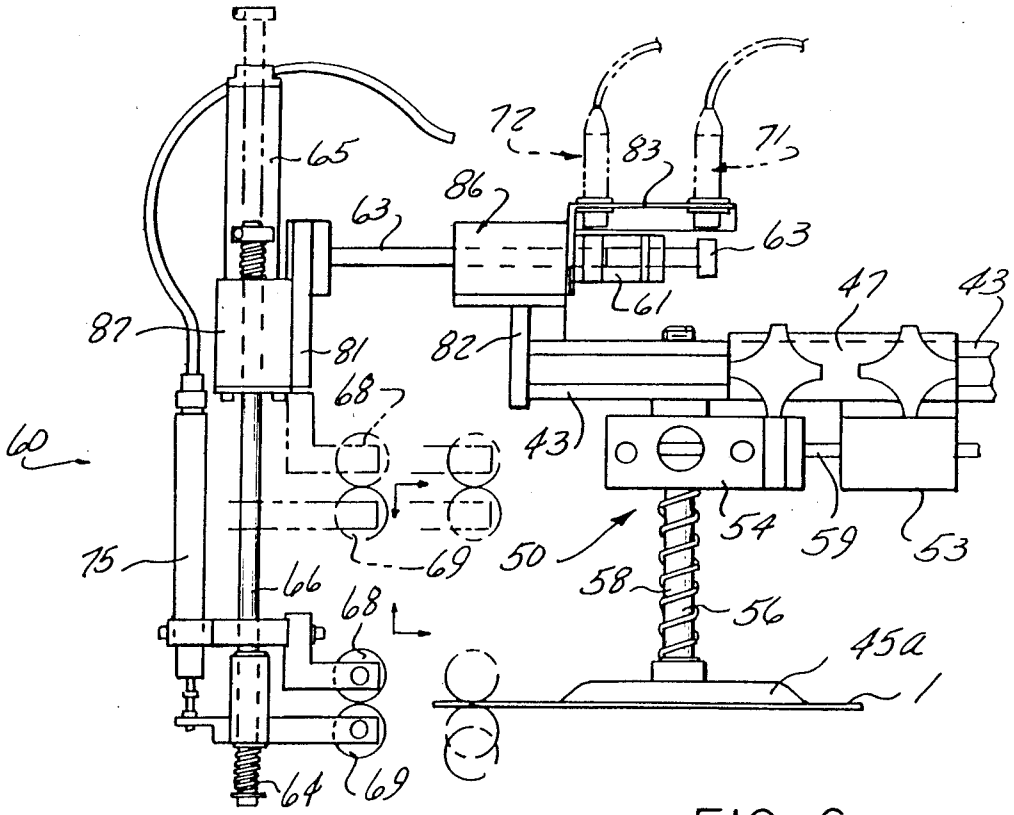

FIG. 6 illustrates the measuring apparatus 60 and the apparatus 50 for moving one of the suction cups 45*a* in two horizontal directions. Mounting brackets 82, 47 mount the measuring apparatus 60 and suction cup movement apparatus 50 to the horizontal member 43 of the lifting assembly. The apparatus 50 that holds a suction cup 45*a* includes two pneumatically powered linear slide units for moving the suction cup 45*a* in two horizontal directions. The units include cylinder housings 53, 54 and a spring 58 cooperating with the vertical member 56 to bias the one suction cup 45*a* downward when the suction cup 45*a* engages and is pressed against a sheet of metal 1. Proximity switches 71, 72 sense the relative location of the guide rods 63 and hence cylinder rod 62 which moves the roller type contact 68, 69 in a horizontal direction. As is shown in this figure, when a sheet of metal 1 is placed between the roller contact 68, 69, they are displaced from each other. In response to this displacement, Transducer 75 supplies an electrical signal to a comparator where it is compared with a reference signal. The reference signal is a pre-selected signal identifying the thickness of a single sheet of metal 1 on the stack of metal sheets. In the event a single sheet of metal 1 is picked up, and another sheet of metal adheres to it for some reason, the signal supplied by the transducer 75 and comparator will be recognized by the controller as more than one sheet and no electrical signal to proceed will be provided to the carriage by the comparator.

Figure 7:
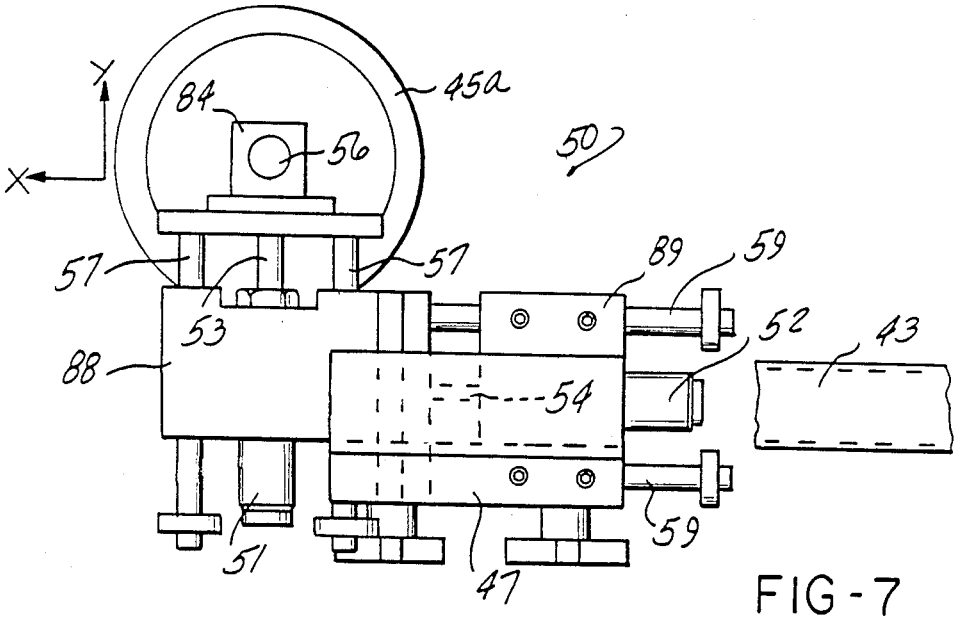

FIG. 7 illustrates how the suction cup 45*a* is moveable in two horizontal directions by two pneumatically operated cylinder housings 51, 52 and their respective cylinder rods 53, 54. Guide rods 57 associated with the first cylinder housing 51 and rod 53 guide the suction cup 45*a* in a first horizontal direction. Guide rods 59 associated with the second cylinder housing 52 and rod 54 guide the suction cup 45*a* in a second horizontal direction perpendicular to the first horizontal direction. The second pneumatic cylinder housing 52 is mounted to horizontal member 43 by bracket 89. Bracket 88 connects the first pneumatic cylinder housing 51 to the cylinder rod 54 of the first housing. Bracket 84 connects the cylinder rod 53 of the first housing 51 to the suction cup 45*a* via vertical member 56. As a result, movement of cylinder rods 53, 54 causes suction cup 45*a* to move in two horizontal directions (X and Y) relative to said horizontal member 43.

Figure 8:
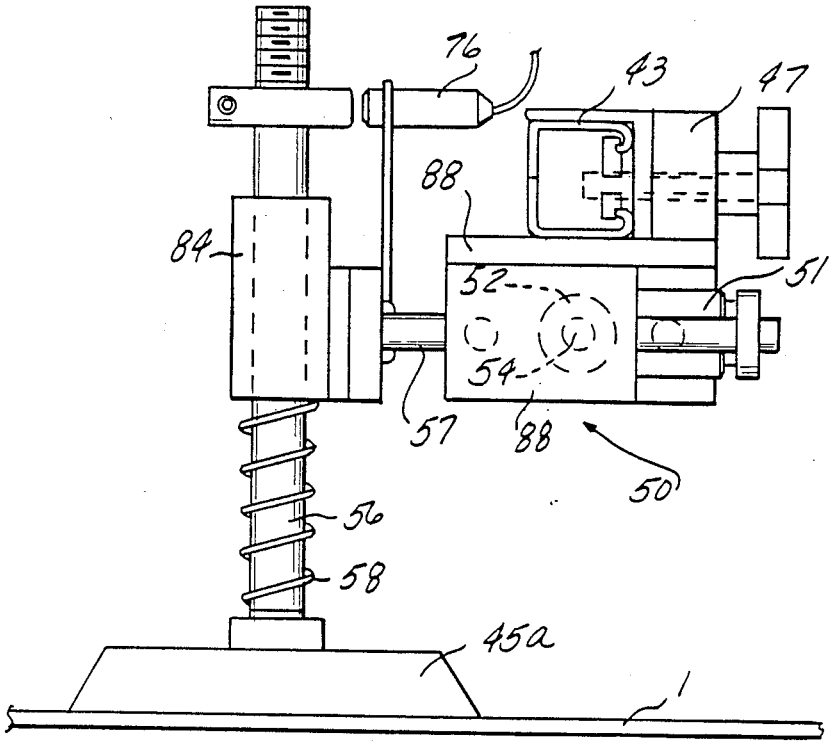
FIGS. 7 through 10 are views of the mechanism that moves one of the suction cups in two horizontal directions.

FIG. 8 illustrates a suction cup 45*a* pressed against a metal sheet 1 by lowering the lifting assembly against the stack of metal sheets. Slideably mounted to the vertical member 56, which is connected to first suction cup 45*a*, is a bracket 84 which connects to the cylinder rod of the pneumatic cylinder housing 51. The second pneumatic cylinder housing 52 being mounted to horizontal member 43 of the lifting assembly by a mechanical clamp 47. The mechanical clamp 47 may be loosened and tightened to relocate the apparatus 50 along horizontal member 43. Also mounted to the sliding bracket 84 is a proximity switch 76 which, in conjunction with a nut located on the vertical member 56, will provide an electrical signal which is a function of the displacement of the suction cup 45*a* from its rest position .

Figure 9:
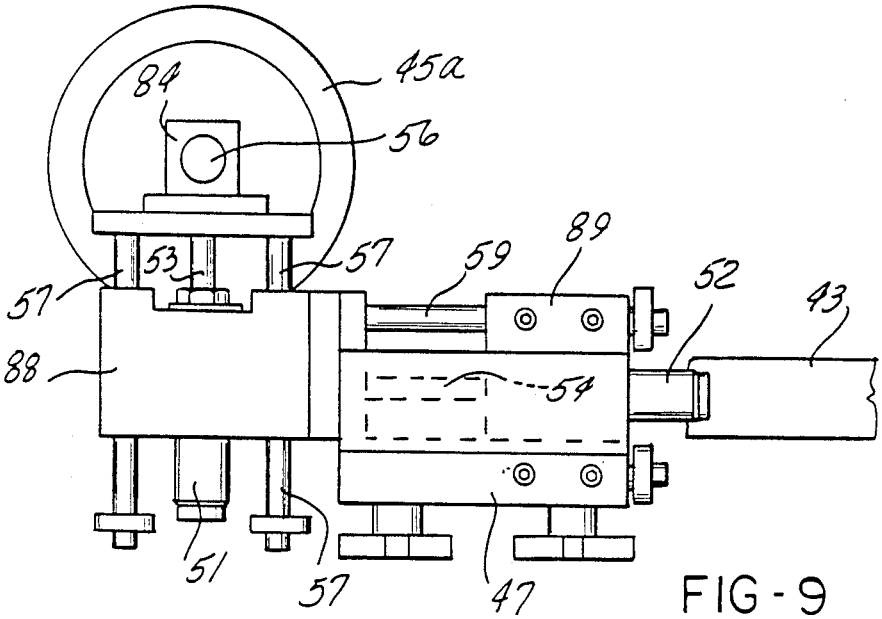

FIG. 9 illustrates the suction cup 45*a* moved in the first horizontal direction as a result of pneumatic pressure applied to the first pneumatic cylinder housing 51 to extend the cylinder rod 53 from the housing 54. This Figure illustrates the position of the cylinder rods 53, 54 of the first and second pneumatic cylinder housings 51, 52 in response to a pneumatic pressure applied to the housings. When the two pneumatic cylinders 51, 52 are operated either sequentially or simultaneously, a sheet of metal attached to the suction cup 45*a* and abutting a locating pin on the punch press work table will pivot about the locating pin. This type of movement is very advantageous when placing a sheet of metal upon the work table as it precisely positions the sheet of metal on the punch press work table for movement by gripping mechanism on the punch press work table.

Although pneumatic cylinders are shown in FIGS. 7–10 hydraulic cylinders or electromechanical devices may also be used.

Figure 10:
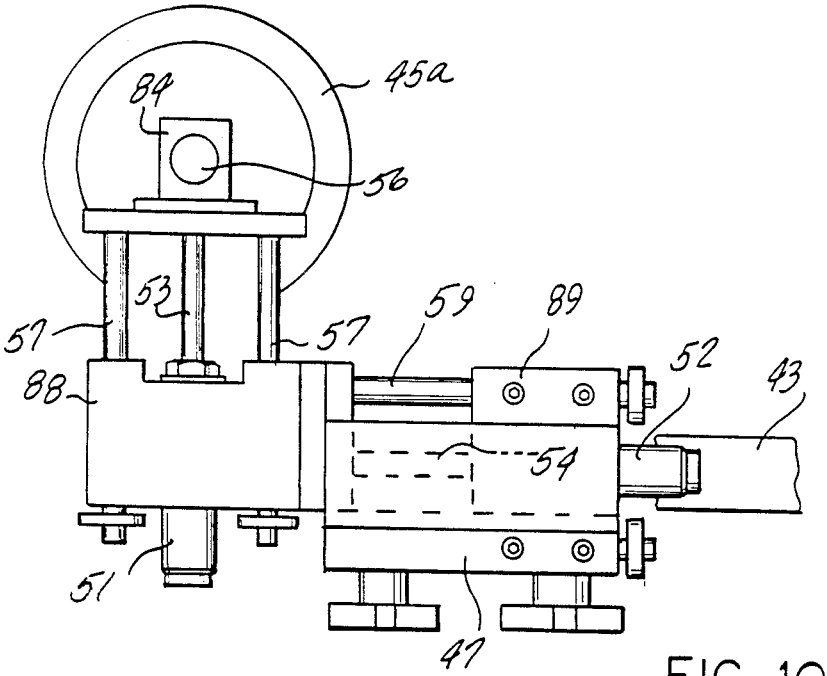

FIG. 10 illustrates the suction cup 45*a* moved in a second horizontal direction as a result of pneumatic pressure in the second pneumatic cylinder housing 52 which extends the cylinder rod 53 and moves the suction cup 45*a* in the second horizontal direction.

Figure 11:
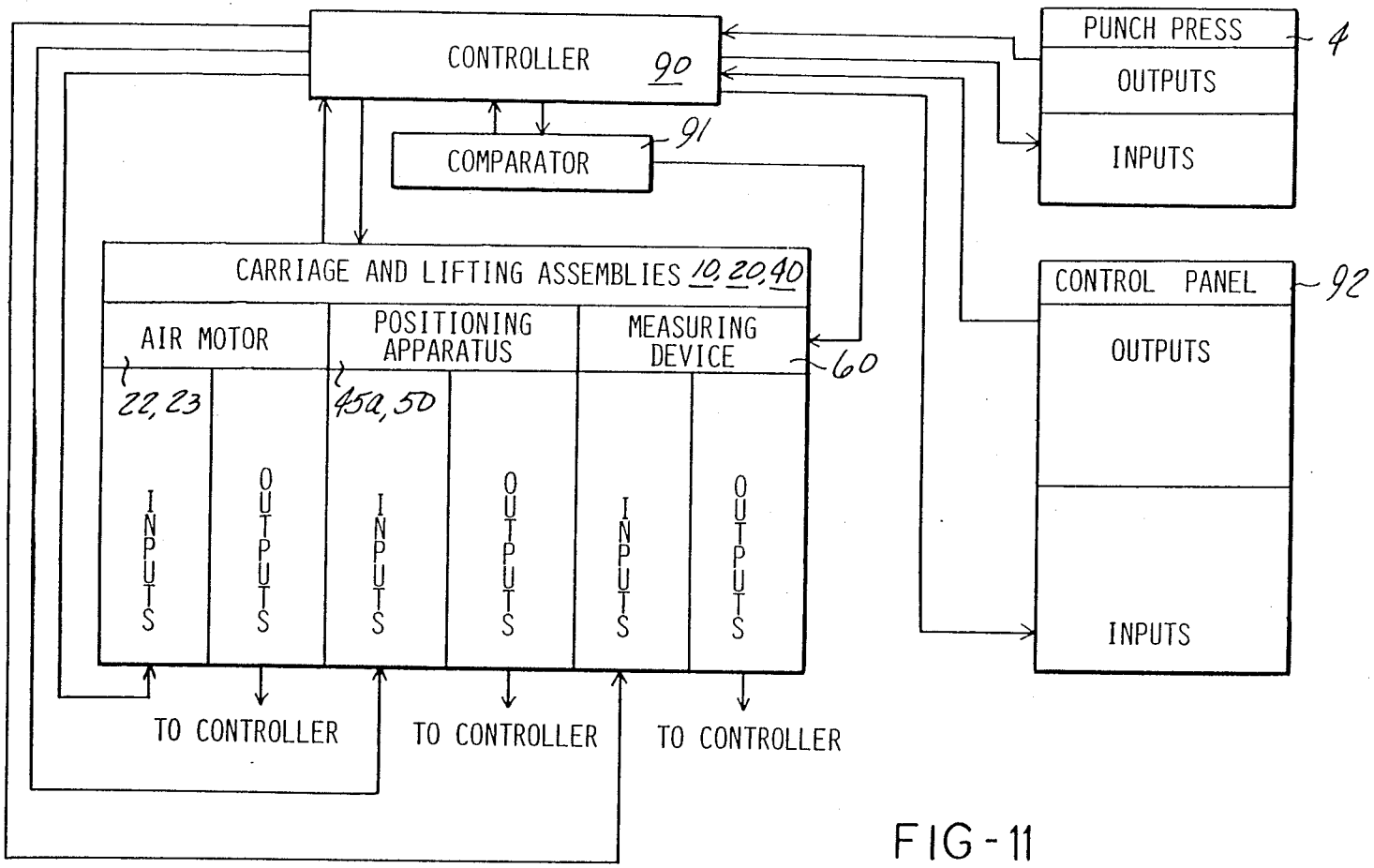
FIGS. 11 and 12 are block diagrams of a system for automatically operating the apparatus shown in FIGS. 1–10.
Figure 12:
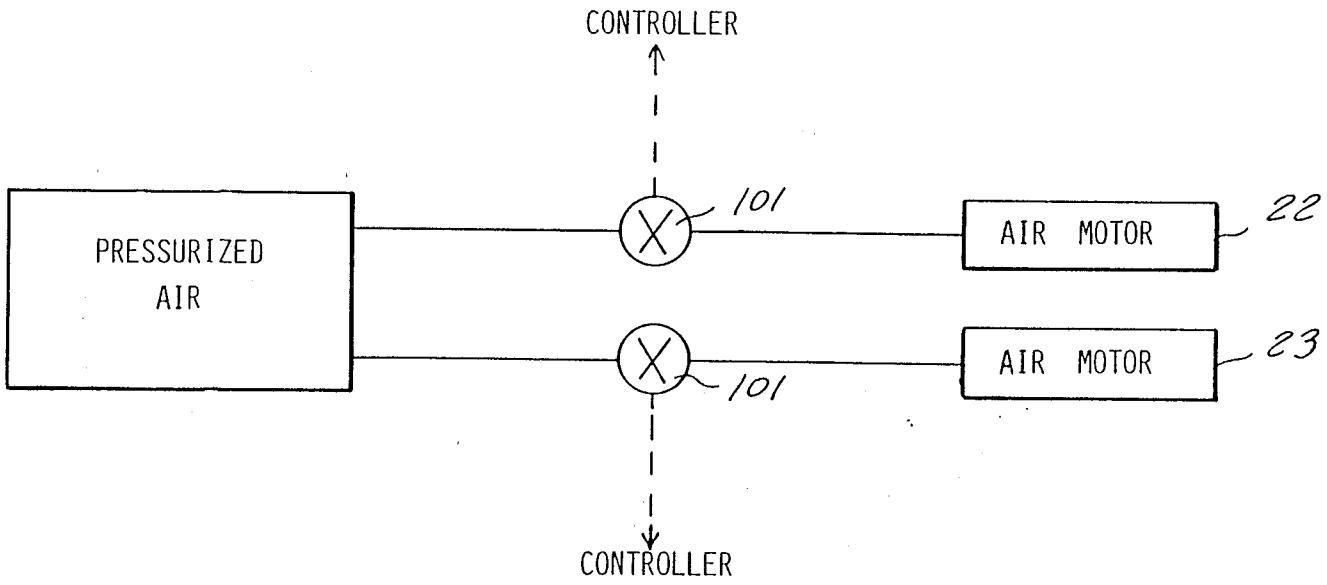
Figure 13A:
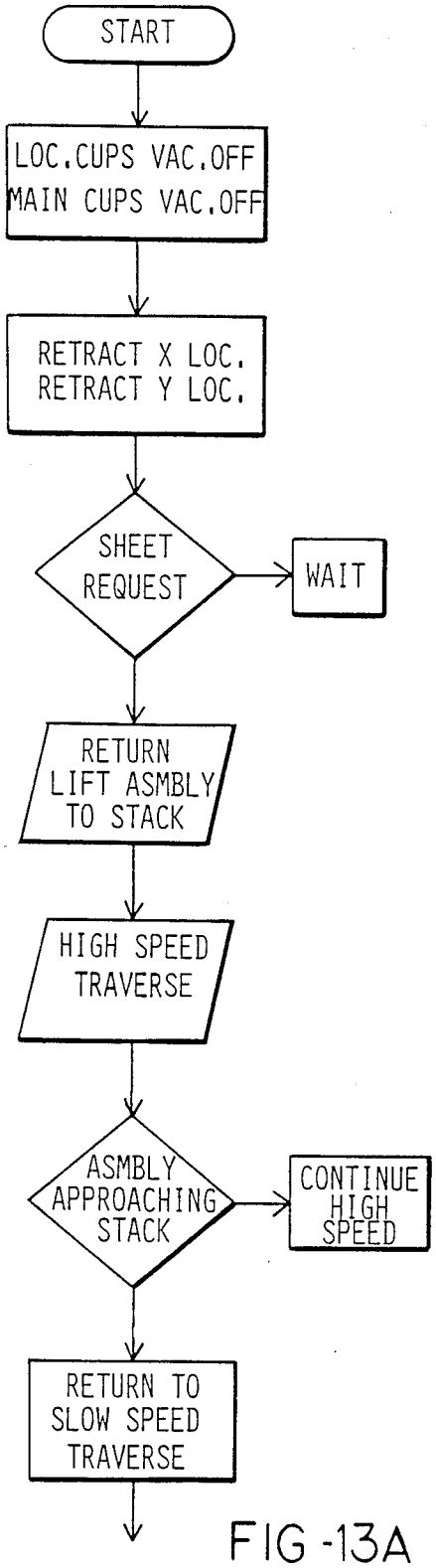
FIGS. 13A through 13H is a flow chart of the automatic operation of the system shown in FIGS. 1 through 12.
Figure 13B:
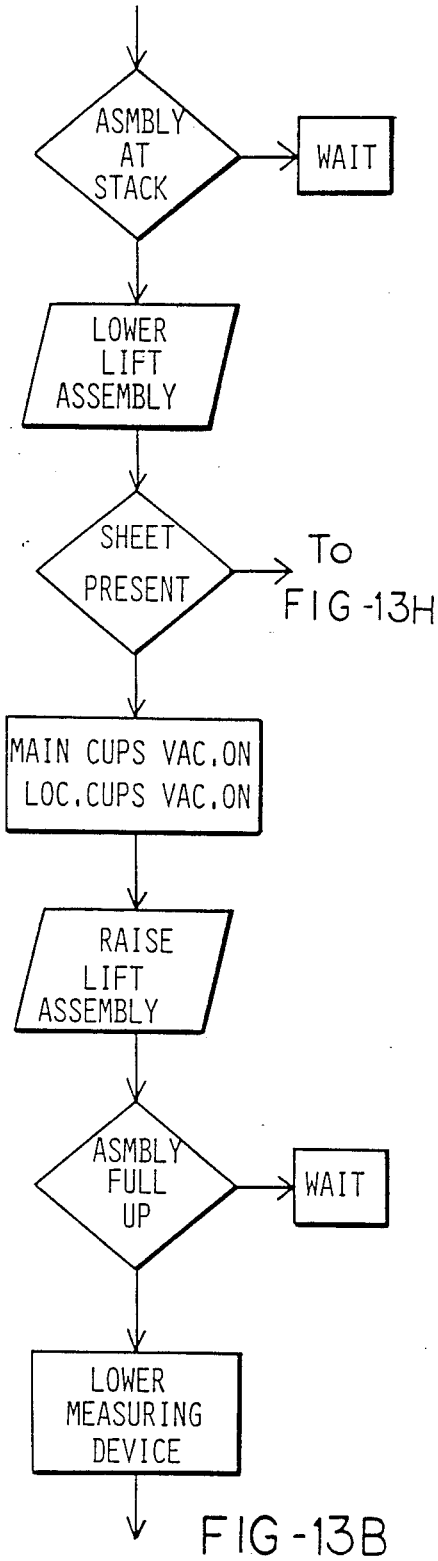
Figure 13C:
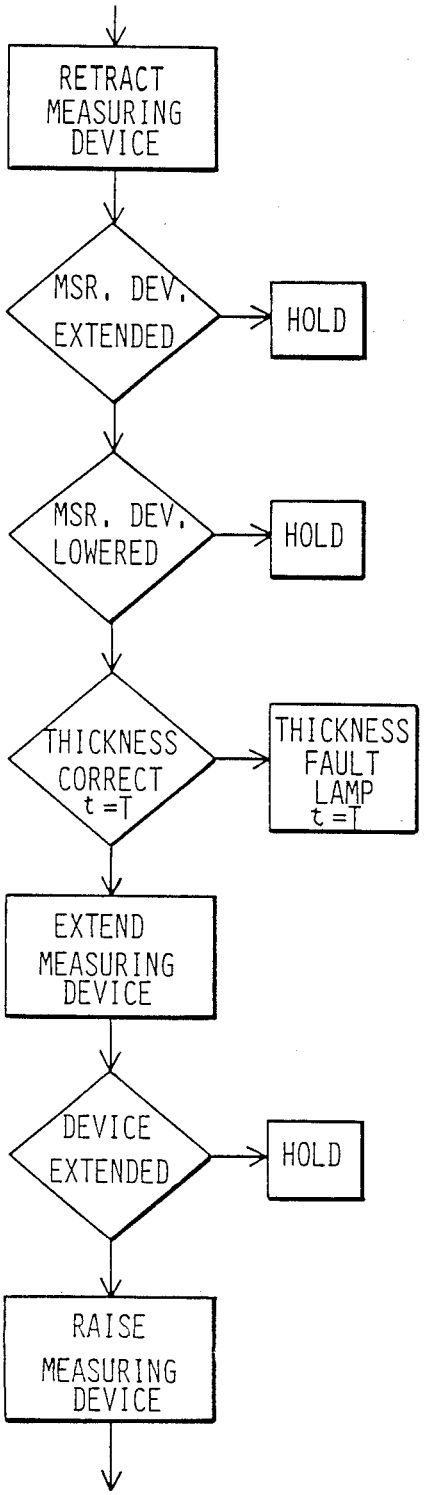
Figure 13D:
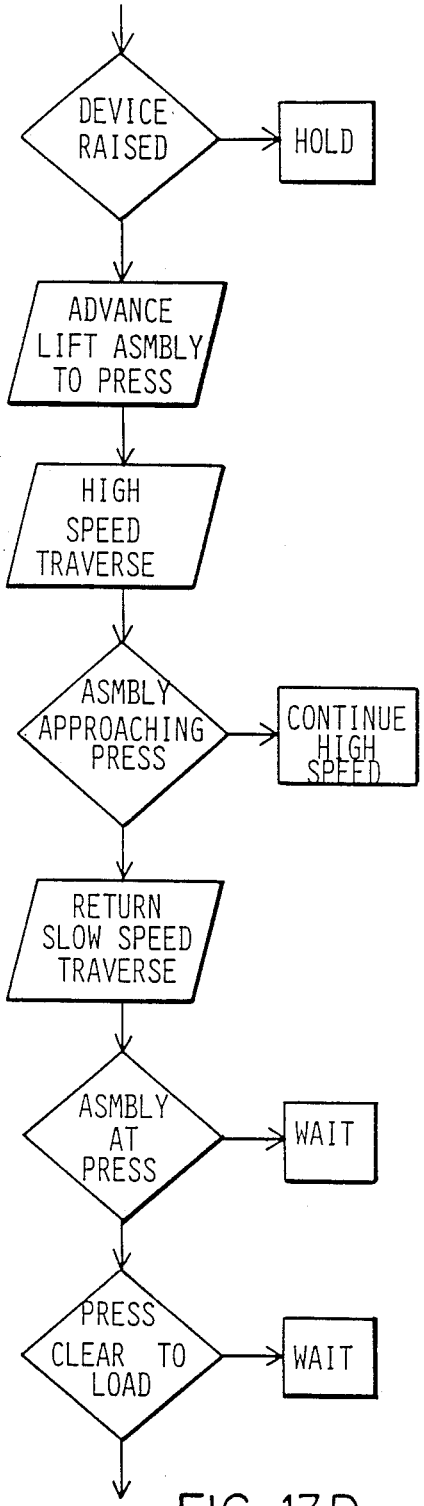
Figure 13E:
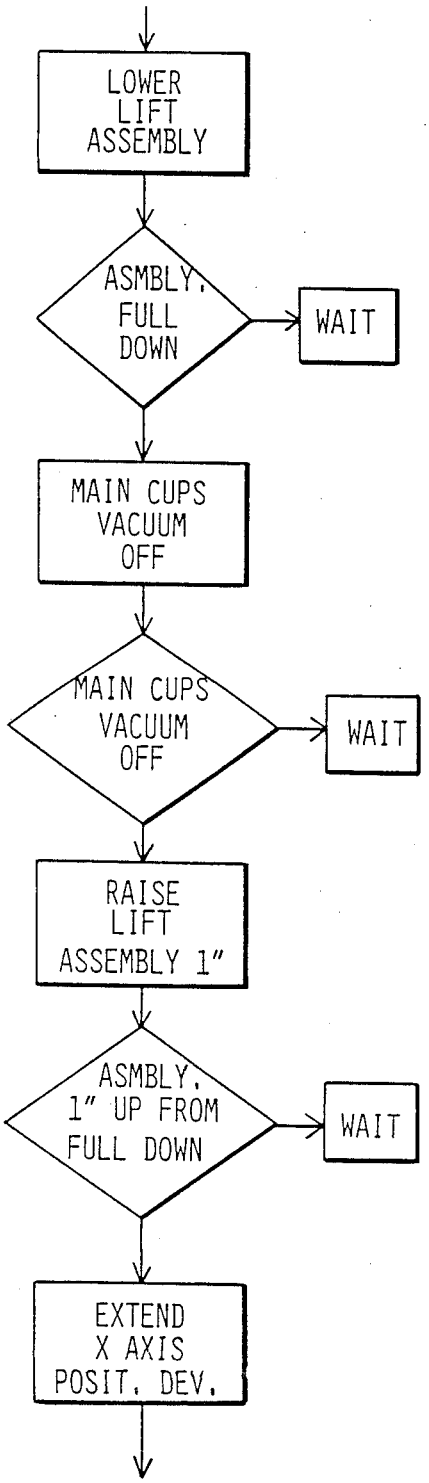
Figure 13F:
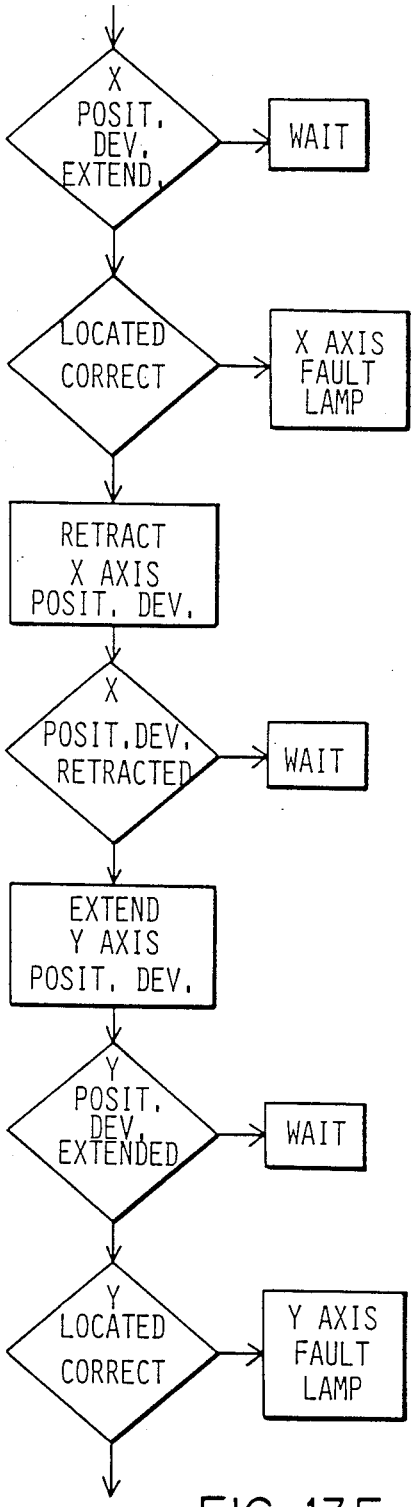
Figure 13G:
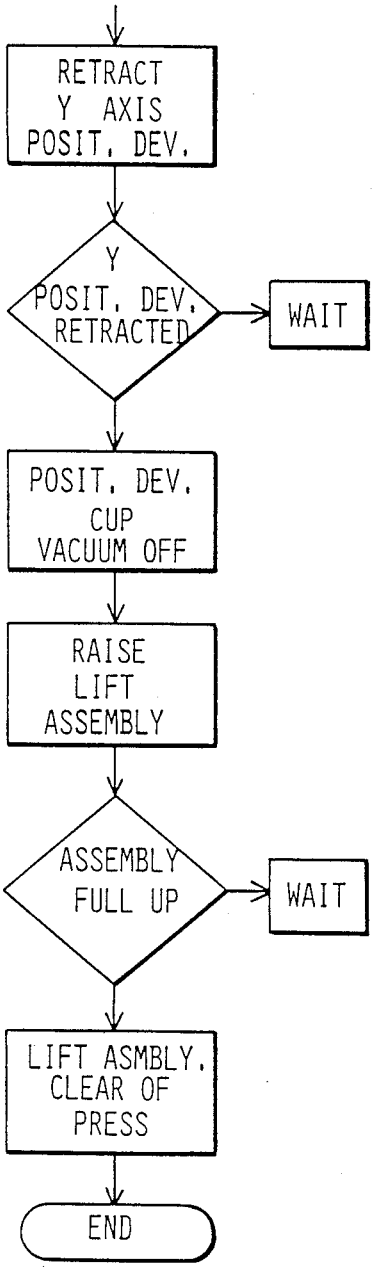
Figure 13H:
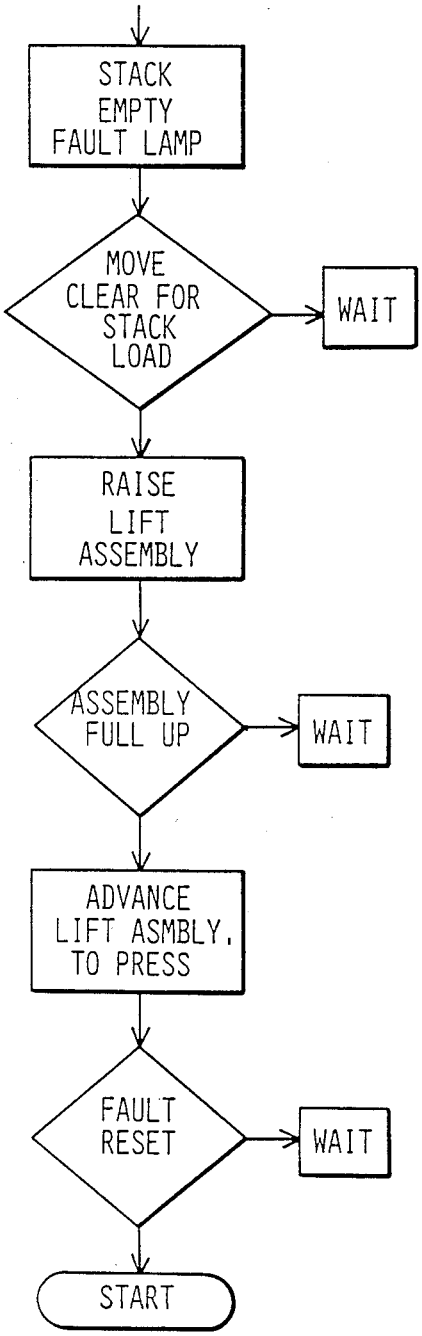

FIGS. 11 and 12 are block diagrams of a system used for automatically controlling the system and apparatus shown in FIGS. 1 through 10. A computer in the form of a controller 90, which has been preprogrammed, receives input signals from various sensing devices and provides proper output signals to control operation of the system. The air motors 22, 23 which move the carriage, and raise and lower the lifting assembly are controlled by electromagnetically operated pneumatic directional control valves 101, and the controller (90, FIG. 1). The valves 101 are available from Numatics, Inc. of Highland, Mich.

The inputs and outputs of the various elements shown in FIG. 11 are as follows:

CARRIAGE AND LIFTING ASSEMBLY - 10, 20, 40

| Outputs to Controller | Inputs to Solenoid Valves from Controller |
|---|---|
| Lifting Assembly at Stack (+) | Return LA to Stack |
| Lifting Assembly Approaching Stack (+) | Advance LA to Press |
| Lifting Assembly at Press (+) | Traverse High Speed |
| Lifting Assembly Approaching Press (+) | Raise Lifting Head |
| Lifting Assembly Full Up (+) | Lower Lifting Head |
| Lifting Assembly Full Down (+) | Suction Cups Vacuum On |
| Lifting Assembly 1" from Full Down (+) | Suction Cups Vacuum Off |
| Advance Lifting Assembly to Press (Switch) | |
| Return Lifting Assembly to Stack (Switch) | |
| Raise Lifting Assembly (Switch) | |
| Lower Lifting Assembly (Switch) | |
| Vacuum On (Switch) | |
| Vacuum Off (Switch) | |

(+) = Cutler-Hammer Proximity Switches - Model E51ALT1 and E57MAL1801.

MEASURING DEVICE - 60

| Outputs to Controller | Inputs to Solenoid Valves from Controller |
|---|---|
| Sheet Press (+) | Lower Measuring Device |
| Measuring Device Rays (+) | Raise Measuring Device |
| Measuring Device Lowered (+) | Extend Measuring Device |
| Measuring Device Retracted (+) | Retract Measuring Device |
| Measuring Device Extended (+) | |
| Extend Measuring Device (Switch) | |
| Return Measuring Device (Switch) | |

POSITIONING APPARATUS - 45a, 50

| Outputs to Controller | Inputs to Solenoid Valves from Controller |
|---|---|
| Extend X Axis (Switch) | Suction Cup Vacuum On |
| Extend Y Axis (Switch) | Suction Cup Vacuum Off |
| Return (Switch) | Extend X Axis |
| | Retract X Axis |
| | Extend Y Axis |
| | Retract Y Axis |

CONTROL PANEL - 92

| Outputs to Controller | Inputs to Indicator Lamps from Controller |
|---|---|
| Auto Start (Switch) | Automatic Mode |
| Manual Start (Switch) | Manual Mode |
| Auto/Manual Reset (Switch) | Y Axis Position Fault |

-continued

| CONTROL PANEL - 92 | |
|---|---|
| Outputs to Controller | Inputs to Indicator Lamps from Controller |
| Cycle Start (Switch) | X Axis Position Fault |
| Cycle Stop (Switch) | Stack Empty |
| Single/Continue Cycle (Switch) | Thickness Fault |
| Small/Large Sheet (Switch) | |
| Fault Reset (Switch) | |
| Cycle Inhibit | |
| Move Clear for Stack Load | |
| Sheet Thickness Signal | |
| Vacuum Switch On/Off | |

| PUNCH PRESS - 4 | |
|---|---|
| Outputs to Controller | Inputs to Interlock Switches From Controller |
| Clear to Load (Switch) | Loader at Start Position |
| Release Sheet (Switch) | Loader Clear of Press |
| Sheet Request (Switch) | Stack Empty |
| Initiate Second Axis Move (Switch) | Thickness Fault |
| Front Grip (Switch) | |

The remaining FIGS. 13A through 13H illustrate a flow chart of the logic for automatically controlling the operation of the lifting assembly 40, the means 10, 20, for moving the lifting assembly, the measuring means 60 and the comparator 91 so that a sheet of metal 1, determined to be a single sheet, may be automatically lifted and moved from a stack of sheets 1, placed on the work table 3 of a punch press 4, and precisely oriented on the work table 3.

The details of the logic flow chart are as follows: Once the controller receives a signal that the vacuum to the suction cups 45 is off and that the pistons of the positioning apparatus 45*a*, 50 are retracted the lifting assembly 40 will proceed to the stack of sheets 1. If these signals are not received the system will wait. The lifting assembly moves at high speed, which is reduced to a slow speed, as it approaches the stack of sheets 1 and is stopped at the stack. If there is no indication that the lifting assembly 40 is at the stack of sheets when the lifting assembly has been stopped the system will wait. If there is an indication that the lifting assembly 40 is at the stack of sheets 1 the suction cups 45 of the lifting assembly will be lowered. If no sheet 1 is detected as being present on the stack (see FIG. 13-H) a stack empty fault lamp will be activated and the lifting assembly 40 will be moved and raised so that sheets can be placed under the lifting assembly. The system would then return to the start position. When a sheet is present at the stack of sheets a vacuum will be provided at the suction cups 45, allowing the lifting assembly 40 to pick up the top sheet. If there is no indication that the lifting assembly is completely raised the system will wait. If there is an indication that the lifting assembly has been completely raised the measuring device 60 will be lowered adjacent the lifted sheet 1 and retracted so that its contacts 68, 69 engage and measure the thickness of the lifted sheet or sheets and provide a signal to the comparator. If the measured thickness is not correct the comparator will provide a "false" signal to the controller and the sheet will not proceed to the work table. If the thickness signal is correct the comparator will disengage the measuring device 60 from the lifted sheet and allow the lifting assembly 40 to advance the sheet to the punch press work table 3. Once the lifting assembly 40 is at the punch press work table 3 the lifting assembly 40 will be lowered until it receives a signal that the lifted sheet has engaged the work table 3. If no signal is received the lifting assembly will wait at the punch press table 3. If such a signal is received the vacuum to all but one of the suction cups 45*a* is removed. The suction cups are then raised one inch to allow easier movement of the sheet by the positioning apparatus 45*a*, 50. The positioning apparatus pistons 51, 52, 53, 54 then move the suction cup 45*a* attached to the sheet 1 in two directions and against locating pins 5, 6 on the punch press work table. Upon receipt of signals from the locating pins 5, 6 that the sheet is properly positioned the vacuum to the last suction cup is removed and the lifting assembly 40 raised and moved away from the punch press work table 3 where it then repeats the sequence shown in FIG. 13-A to 13-H.

OPERATION

Automatic operation by the controller 90 begins after it receives an electrically coded signal from the punch press operator as to the proper metal sheet thickness "T" for the punch press 4. The carriage 20 is moved by motor 23 to a position over the stack of sheets 1 where motor 22 lowers the suction cups 45 of lifting assembly 40 until a sensor detects pressure against the top metal sheet 1. Down motion is then stopped and a vacuum is applied to the suction cups 45. The lifting assembly 40 then raised the suction cups 45 and the metal sheet or sheets attached to the suction cups. While the teeth or sheets are being raised, measuring apparatus 60 extends cylinder 63, then lowers cylinders 65 to the height of the suction cups. Cylinder 63 is then retracted to engage the roller contacts 68, 69 onto the sheet or sheets. As a result, the LVDT transducer 75 generates an electrical signal "t", which represents the measured thickness of the raised sheet or sheet, and sends it to the comparator 91. Cylinders 63, 65 then disengage the roller contacts from the sheet and raise measuring device 60 out of the way. If more than one metal sheet 1 is raised, the signal "t" provided by the measuring device 60 will not be substantially equal to the coded thickness "T" and the lifting assembly 40 returns the sheets to the stack and sends a signal to the punch press operator. Alternately, if the measuring apparatus 60 confirms that a single sheet has been picked up ("t" substantially equal to "T") the carriage 20 and lifting assembly 40 move until the sheet is positioned over the punch press work table 3. The lifting assembly is then lowered until the sheet 1 held by the suction cups 45 is resting on the top of the punch press work table 3. An appropriate sensor on the lifting assembly or work table then sends a signal back to the controller that the metal sheet 1 is resting on the top surface of the work table 3 and the vacuum on all but one 45*a* of the suction cups 45 are released and raised slightly. Pneumatic cylinders 51, 52, 53, 54 then cause suction cup 45*a* and the attached sheet 1 to move in two horizontal directions, preferably perpendicular to each other. This movement precisely locates the sheet 1 on the punch press table against locating pins 5, 6 mounted on the surface of the punch press work table 3. Sensors in the locating pins 5, 6 provide a signal to the controller when the sheet 1 is in contact with both locating pins. This signal causes the release of the remaining suction cup 45*a* and allows the punch press mechanisms to take over further processing of the sheet 1. The carriage 20 then returns to a position over the stack of sheets to repeat the process until the stack of sheets is depleted or the process is stopped.

Alternate embodiments of the invention would include: the use of non contact gauging techniques and apparatus; and the use of other parameters of the material, such as size and weight. For example, a weight sensing transducer can be substituted for the thickness measuring transducer 75 shown in FIG. 4. One example of such a weight sensing transducer is a strain gauge made by Revere Incorporated or Streeter Amet Inc.

What is claimed is:

1. An Apparatus for lifting and moving at least one sheet (1) from a stack of sheets characterized by:

a lifting assembly (40) comprising (a) a plurality of means (45) releasably attachable to the top sheet (1) on said stack of sheets;

(b) means for supporting (43) and moving (41, 42) said plurality of attachable means (45) up and down;

(c) means (60) movable up and down with said attachable means for measuring the thickness (t) of what has been lifted by said attachable means (45); and means (10, 20) for moving the lifting assembly (4) and what has been lifted from the slack of sheets (1) when the measured thickness (5) of what has been lifted is in a predetermined relationship to a reference parameter (T).

2. The apparatus as recited in claim 1 including:

means (90, 22, 23) for automatically controlling the operation of the lifting assembly (40), the means (10, 20) for moving the lifting assembly, and the measuring means (60) whereby a sheet (1), determined to be a single sheet, may be automatically lifted and moved from a stack of sheets (1).

3. An apparatus for lifting and moving individual sheets (1) from a stack of sheets onto a work processing table (3) of a punch press (4), characterized by:

a lifting assembly (40) comprising (a) a plurality of means (45) releasably attachable to the upper surface of the top sheet (1) on said stack of sheets; and (b) means for moving (41, 42) said plurality of attachable means (45) up and down;

means (10, 20) for moving the lifting assembly (40) between the stack of sheets (1) and the work processing table (3) of the punch press (4);

means (60) movable up and down with said attachable means for measuring the thickness (t) of what has been lifted by said attachable means (45); and means (91) for comparing the measured thickness (t) of what has been lifted by said attachable means (45) to a predetermined reference parameter (T) and allowing said means for moving the lifting assembly (10, 20) to move the lifting assembly (40) from the stack of sheets (1) to the work processing table (3) of the punch press (4) when the measured thickness (5) of what has been lifted is in a predetermined relationship to the reference parameter (T).

4. The apparatus as recited in claim 3 including:

means (90, 22, 23) for automatically controlling the operation of the lifting assembly (40), the means (10, 20) for moving the lifting assembly, the measuring means (60) and the comparing means (91) whereby a sheet (10), determined to be a single sheet, may be automatically lifted and moved from a stack of sheets (1) and deposited on the work table (3) of a punch press (4).

5. The apparatus as recited in claim 3 wherein said means for moving (41, 42) said plurality of attachable means (45) up and down includes means (47) providing for rearrangement of said attachable means (45), whereby said attachable means (45) may be arranged to pick up sheets (1) of different sizes.

6. The apparatus as recited in claim 4 wherein said means for moving (41, 42) said plurality of attachable means (45) up and down includes means (47) providing for rearrangement of said attachable means (45), whereby said attachable means (45) may be arranged to pick up sheets (1) of different sizes.

7. The apparatus as recited in claim 3 wherein said releasably attachable means (45) are pneumatically operated suction cups.

8. The apparatus as recited in claim 4 wherein said releasably attachable means (45) are pneumatically operated suction cups.

9. The apparatus as recited in claim 5 wherein said releasably attachable means (45) are pneumatically operated suction cups.

10. The apparatus as recited in claim 6 wherein said releasably attachable means (45) are pneumatically operated suction cups.

* * * * *